US011825284B2

(12) United States Patent
Sunamoto et al.

(10) Patent No.: US 11,825,284 B2
(45) Date of Patent: Nov. 21, 2023

(54) ACOUSTIC DIAPHRAGM, MANUFACTURING METHOD THEREFOR, AND ACOUSTIC DEVICE

(71) Applicant: KURARAY CO., LTD., Kurashiki (JP)

(72) Inventors: Tatsuya Sunamoto, Chiyoda-ku (JP); Xianwen Zhang, Chiyoda-ku (JP)

(73) Assignee: KURARAY CO., LTD., Kurashiki (JP)

( * ) Notice: Subject to any disclaimer, the term of this patent is extended or adjusted under 35 U.S.C. 154(b) by 0 days.

(21) Appl. No.: 17/662,521

(22) Filed: May 9, 2022

(65) Prior Publication Data

US 2022/0264226 A1 Aug. 18, 2022

Related U.S. Application Data

(63) Continuation of application No. PCT/JP2020/042035, filed on Nov. 11, 2020.

(30) Foreign Application Priority Data

Nov. 15, 2019 (JP) ..... 2019-206760
May 21, 2020 (JP) ..... 2020-088753

(51) Int. Cl.
*H04R 7/12* (2006.01)
*H04R 7/08* (2006.01)
(Continued)

(52) U.S. Cl.
CPC ..... *H04R 7/12* (2013.01); *H04R 7/18* (2013.01); *H04R 31/003* (2013.01); *H04R 2307/025* (2013.01)

(58) Field of Classification Search
CPC ..... H04R 2307/025; H04R 7/12; H04R 7/18
See application file for complete search history.

(56) References Cited

FOREIGN PATENT DOCUMENTS

CN 206024094 U 3/2017
JP 52-101022 A 8/1977
(Continued)

OTHER PUBLICATIONS

David, J Shuman, Calculating the elastic modulus from nanoindentation and microindentation reload curves, Jun. 3, 2005) (Year: 2005).*

(Continued)

*Primary Examiner* — Sunita Joshi
(74) *Attorney, Agent, or Firm* — Oblon, McClelland, Maier & Neustadt, L.L.P.

(57) ABSTRACT

Provided is an acoustic diaphragm with required properties for a vibrating part and an edge part thereof. The acoustic diaphragm comprises a vibrating part 11 and an edge part 12 located at an outer periphery of the vibrating part, wherein the vibrating part comprises a thermoplastic liquid crystal polymer (TLCP) having a certain composition; the edge part comprises a TLCP having a same composition as the TLCP of the vibrating part; and the vibrating part 11 and the edge part 12 have elastic moduli $E_d$ and $E_e$ measured by nanoindentation technique, respectively, which satisfy the following formula: $E_d > E_e$. For example, a ratio $E_d/E_e$ of the elastic modulus $E_d$ of the vibrating part 11 to the elastic modulus $E_e$ of the edge part 12 may fall within a range of from 1.05 to 5.0.

12 Claims, 2 Drawing Sheets

(51) Int. Cl.
*H04R 31/00* (2006.01)
*H04R 7/18* (2006.01)

(56) References Cited

FOREIGN PATENT DOCUMENTS

| | | | | | |
|---|---|---|---|---|---|
| JP | 52101022 | A | * | 8/1977 | ..... H04R 7/127 |
| JP | 6-153292 | A | | 5/1994 | |
| JP | 2005-168050 | A | | 6/2005 | |
| JP | 2010-187365 | A | | 8/2010 | |
| JP | 2010-268033 | A | | 11/2010 | |
| WO | WO 2017/130972 | A1 | | 8/2017 | |

OTHER PUBLICATIONS

International Preliminary Report on Patentability and Written Opinion dated May 27, 2022 in PCT/JP2020/042035 (submitting English translation only), 5 pages.
International Search Report dated Feb. 9, 2021 in PCT/JP2020/042035 filed Nov. 11, 2020, 2 pages.

* cited by examiner

ACOUSTIC DIAPHRAGM, MANUFACTURING METHOD THEREFOR, AND ACOUSTIC DEVICE

CROSS REFERENCE TO THE RELATED APPLICATION

This application is a continuation application, under 35 U.S.C. § 111(a), of international application No. PCT/JP2020/042035 filed Nov. 11, 2020, which claims priorities to Japanese patent application No. 2019-206760, filed Nov. 15, 2019, and Japanese patent application No. 2020-88753, filed May 21, 2020, the entire disclosures of all of which are herein incorporated by reference as a part of this application.

FIELD OF THE INVENTION

The present invention relates to an acoustic diaphragm comprising a thermoplastic polymer capable of forming an optically anisotropic melt phase (hereinafter, referred to as thermoplastic liquid crystal polymer or sometimes abbreviated as TLCP), to a production method therefor, as well as to an acoustic device comprising such an acoustic diaphragm.

BACKGROUND OF THE INVENTION

Recently, sound content with a far larger amount of information than before, called as "high-resolution audio," "high-resolution audio content," or simply "hi-res audio," started to become widely available. The high-resolution audio content refers to music data with a sampling frequency of 48 kHz or 96 kHz or higher and a quantization bit rate of 24 bits or higher, both of which are higher than those of conventional music compact discs (44.1 kHz/16 bit). With widespread use of the high-resolution audio content, there has been an increasing demand for acoustic diaphragms for loudspeakers, headphones, etc., like never before.

In general, an acoustic diaphragm is constituted by a vibrating part and an edge part, each of which plays a distinct role from the other. Since the vibrating part of the acoustic diaphragm is required to have a high propagation speed ($(E/\rho)^{1/2}$) and an adequate internal loss, which indicates a degree of vibration attenuation, for the reasons of frequency characteristics, a material used for the vibrating part should be lightweight (i.e., have a low density $\rho$) and have a high elastic modulus E and a high internal loss. As for the edge part of the acoustic diaphragm, the edge part is located around outer periphery of the vibrating part and thus is required not only to support and retain the outer periphery of the vibrating part at an appropriate position, but also to flexibly and freely move to follow a movement of the vibrating part without disturbing the movement so as to suppress divided vibration. Accordingly, a material used for the edge part should be relatively flexible and have a high internal loss. That is, these parts are required to have different properties; thus, a material for the vibrating part should have a high elastic modulus, whereas a material for the edge part should have a relatively low elastic modulus.

For this reason, it has been conventionally proposed to produce a vibrating part and an edge part of an acoustic diaphragm as separate pieces to impart required properties to them, respectively, and to bond these pieces together by using an adhesive or the like.

For example, Patent Document 1 (International Publication No. 2017/130972) discloses a diaphragm edge material for an electroacoustic converter characterized by containing, as a main component, a polyamide resin (A) including: a dicarboxylic acid (a-1) including terephthalic acid as a main component; and a diamine component (a-2) including an aliphatic diamine as a main component. Patent Document 1 also describes a configuration in which such an edge material is attached around a highly elastic body attached to a voice coil.

Patent Document 2 (JP Laid-open Patent Publication No. H6-153292) discloses an edge material for a loudspeaker, the edge material including a binder-free cotton nonwoven fabric impregnated or coated with a molding resin. Patent Document 2 also describes a free edge cone for a loudspeaker, in which such an edge material is bonded to an outer peripheral part of a loudspeaker diaphragm.

Patent Document 3 (JP Laid-open Patent Publication No. 2005-168050) discloses a method of producing a loudspeaker diaphragm, the method including press forming a single sheet from wood used as a base material into a substantially trumpet shape.

CONVENTIONAL ART DOCUMENT

Patent Document

[Patent Document 1] International Publication No. 2017/130972

[Patent Document 2] JP Laid-open Patent Publication No. H6-153292

[Patent Document 3] JP Laid-open Patent Publication No. 2005-168050

SUMMARY OF THE INVENTION

In a case where the vibrating part and the edge part are made of different materials as in Patent Documents 1 to 3, however, these parts need to be bonded with an adhesive. As a result, there is a possibility that the diaphragm cannot offer intended performance at adhesive-applied portions necessary for bonding the different materials, so that the vibrating part and the edge part as a whole may have different performance from originally designed values. In addition, the diaphragm is thickened at the bonded portions due to the presence of the adhesive, so that it may be difficult to achieve a desired thickness in a case where a thinnest possible sheet is sought for. Increase in thickness may lead to deteriorated acoustic characteristics due to higher rigidity of the edge part and/or increased mass of the diaphragm.

Use of an adhesive may lead to deterioration in heat resistance. For example, in a case of an acoustic diaphragm for a vehicle, such an acoustic diaphragm is exposed to high temperature for a long period of time, which leads to a problem in that the bonded portions do not have sufficient heat resistance.

Accordingly, an object of the present invention is to provide an acoustic diaphragm comprising a vibrating part and an edge part, wherein the acoustic diaphragm achieves required properties for the vibrating part and the edge part at the same time in spite of the fact that the vibrating part and the edge part are made of a same compositional material, as well as a producing method therefor.

Another object of the present invention is to provide an acoustic device comprising such an acoustic diaphragm.

Based on the result of intensive studies to achieve the above objects, the inventors of the present invention first focused on a thermoplastic liquid crystal polymer that is a material having high elastic modulus and high internal loss, and found that a film formed from such a material has high elastic modulus and is suitable as a material for an acoustic diaphragm, and further have found that elastic modulus of a TLCP film can be changed by applying heat-treatment to the film. Meanwhile the inventors also have found that local elastic modulus can be accurately measured only by nanoindentation technique and that heat-treatment to a portion corresponding to an edge part allows the edge part to have an elastic modulus lower than an elastic modulus of a vibrating part, in spite of the fact that these parts are made of a same compositional material. The inventors have thus achieved the present invention.

That is, the present invention may include the following aspects.

Aspect 1

An acoustic diaphragm comprising a vibrating part and an edge part located at an outer periphery of the vibrating part, wherein the vibrating part comprises a thermoplastic liquid crystal polymer (TLCP) having a certain composition; the edge part comprises a TLCP having a same composition as the TLCP of the vibrating part; and the vibrating part and the edge part have elastic moduli $E_d$ and $E_e$ measured by nanoindentation technique, respectively, which satisfy the following formula: $E_d > E_e$.

Aspect 2

The acoustic diaphragm according to aspect 1, wherein the acoustic diaphragm has a ratio $E_d/E_e$ of the elastic modulus $E_d$ of the vibrating part relative to the elastic modulus $E_e$ of the edge part within a range of from 1.05 to 5.0 (preferably from 1.1 to 4.0, and more preferably from 1.2 to 3.0).

Aspect 3

The acoustic diaphragm according to aspect 1 or 2, wherein the elastic modulus $E_d$ of the vibrating part falls within a range of from 6.0 to 15.0 GPa (preferably from 6.5 to 14.0 GPa, and more preferably from 7.0 to 13.0 GPa).

Aspect 4

The acoustic diaphragm according to any one of aspects 1 to 3, wherein the elastic modulus $E_e$ of the edge part falls within a range of from 4.5 to 12.0 GPa (preferably from 5.0 to 12.0 GPa, more preferably from 5.5 to 11.0 GPa, and further preferably from 6.0 to 10.0 GPa).

Aspect 5

The acoustic diaphragm according to any one of aspects 1 to 4, wherein each of the vibrating part and the edge part has an internal loss tan δ of from 0.03 to 0.08 (preferably from 0.04 to 0.08, and more preferably from 0.05 to 0.08).

Aspect 6

The acoustic diaphragm according to any one of aspects 1 to 5, wherein the acoustic diaphragm has different thicknesses between the vibrating part and the edge part with a difference in thickness being 10 μm or smaller (preferably 5 μm or smaller, and more preferably 3 μm or smaller).

Aspect 7

A method for producing the acoustic diaphragm as recited in any one of aspects 1 to 6, wherein the vibrating part and the edge part are formed from a TLCP film as a base material, the method comprising:

subjecting a portion of the TLCP film to heat treatment, the portion being used as the edge part, or subjecting an edge part piece for a TLCP molded product to heat treatment, the edge part piece being molded from the TLCP film.

Aspect 8

The method according to aspect 7, wherein the heat treatment is carried out at a temperature of from (Tm−30)° C. to (Tm+30)° C. (preferably from (Tm−25)° C. to (Tm+20°) C, and more preferably from (Tm−20)° C. to (Tm+10)° C.) wherein Tm denotes a melting point of the TLCP film.

Aspect 9

The method according to aspect 7, wherein the heat treatment is carried out using ultrasonic heat treatment.

Aspect 10

The method according to any one of aspects 7 to 9, wherein the TLCP film before the heat treatment has a segment orientation ratio (SOR) of from 0.80 to 1.30 (preferably from 0.85 to 1.25, and more preferably from 0.90 to 1.20).

Aspect 11

An acoustic device comprising the acoustic diaphragm as recited in any one of aspects 1 to 6.

Aspect 12

The acoustic device according to aspect 11, wherein the acoustic device is a loudspeaker, a headphone, or an earphone.

The present invention encompasses any combination of at least two features disclosed in the claims and/or the specification and/or the drawings. In particular, any combination of two or more of the appended claims should be equally construed as included within the scope of the present invention.

Effects of the Invention

According to the present invention, an acoustic diaphragm comprising a vibrating part and an edge part can achieve required properties for the vibrating part and for the edge part at the same time, in spite of the fact that the vibrating part and the edge part are made of a same compositional material.

BRIEF DESCRIPTION OF THE DRAWINGS

The present invention will be more clearly understood from the following description of preferred embodiments thereof, when taken in conjunction with the accompanying drawings. The drawings are not necessarily shown at a consistent scale and are exaggerated in order to illustrate the principle of the present invention. The embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like or corresponding parts throughout the several views. In the figures.

DESCRIPTION OF THE EMBODIMENTS

Hereinafter, embodiments of the present invention will be described with reference to the drawings. The present invention, however, is not limited to the illustrated embodiments.

Figure 1:
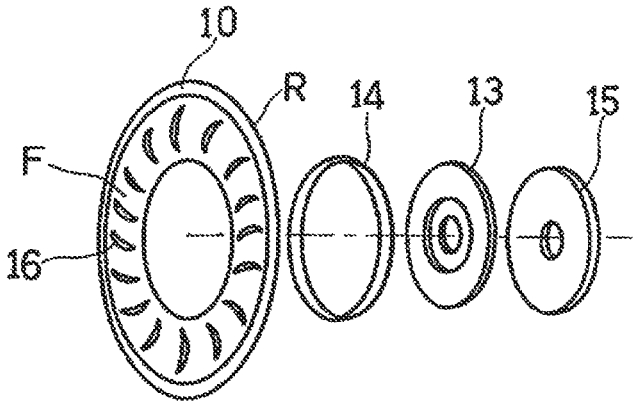
FIG. 1 is an exploded schematic perspective view illustrating main parts of an earphone-type acoustic device according to one embodiment of the present invention.

FIG. 1 shows an exploded schematic perspective view for illustrating main parts inside a housing of an earphone-type acoustic device according to one embodiment of the present invention. The acoustic device at least comprises: an acoustic diaphragm 10, a pole piece 13, a voice coil 14, and a magnetic body 15. In addition to these main parts, the acoustic device may be appropriately provided with, although not illustrated, an enclosure, an ear pad, an acoustic register, a protector, and others. Where the magnetic body alone can produce a desired magnetic field, the pole piece may be omitted.

In FIG. 1 showing the main parts of the acoustic device, the acoustic diaphragm 10 has an F side as a surface facing the ear and an R side as a surface facing opposite to the ear, with the pole piece 13, the voice coil 14, and the magnetic body 15 arranged on the R side.

The magnetic body 15 generates a magnetic flux to produce a magnetic field inside the acoustic device through the pole piece 13. The voice coil 14 is arranged in a cylindrical manner so as to surround the magnetic body 15, and one end of the voice coil is bonded to the R side of the acoustic diaphragm 10. The voice coil 14 may be disposed as a voice coil bobbin.

The voice coil 14 is connected to an electrode (not illustrated), so that an electric current from the electrode in accordance with an inputted audio signal flows into the voice coil 14. When the electric current flows into the voice coil 14, the voice coil 14 receives a force from the magnetic field in accordance with the magnitude of the electric current. As a result, vibration generates in the voice coil 14, and the vibration propagates to the acoustic diaphragm 10, to which the voice coil 14 is bonded. Accordingly, the acoustic diaphragm 10 is caused to vibrate in conjunction with the vibration from the voice coil 14. When the acoustic diaphragm 10 vibrates, the vibration is transmitted through the air and generates sound pressure in accordance with the inputted audio signal.

Figure 2:
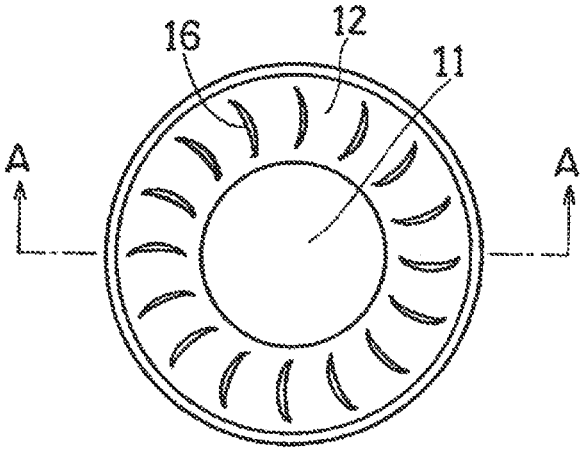
FIG. 2 is a schematic plan view illustrating an acoustic diaphragm of the acoustic device of FIG. 1.

FIG. 2 shows a plan view of the acoustic diaphragm 10 of FIG. 1. The acoustic diaphragm 10 is a dome-shaped diaphragm including a dome-shaped vibrating part 11 and an edge part 12. The vibrating part 11 is located at the center and the edge part 12 is located at the periphery, with the boundary between them defined at a contact position of the voice coil 14.

In FIG. 2, the edge part 12 includes a plurality of grooves 16. Such grooves 16 make it possible to disperse and release strain in a circumferential direction, so that resonance of the acoustic diaphragm can be suppressed. In such a manner, various properties can be imparted to the acoustic diaphragm by the shape of the edge part. The shape of the edge part, however, is not limited to a particular one. For example, the edge part may have any of various edge shapes such as a rolled edge, a corrugated edge, a gathered edge, and a tangential edge, etc.

Figure 3:
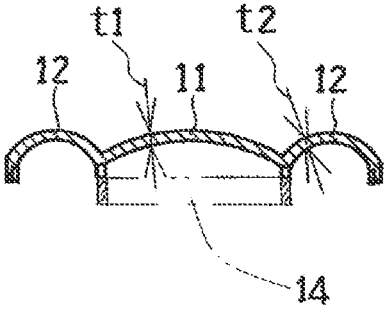
FIG. 3 is a schematic cross-sectional view along line A-A of the acoustic diaphragm of FIG. 2.

FIG. 3 shows a cross-sectional view along line A-A of the acoustic diaphragm 10 of FIG. 2. The vibrating part 11 and the edge part 12 are formed as a single piece, and each of the vibrating part and the edge part is moderately convex in a direction in which the sound pressure is generated (i.e., toward the F side).

As long as the effect of the present invention can be attained, the acoustic diaphragm according to the present invention is not limited to a specific shape and may have any of various shapes such as a dome shape, a corn (conical) shape, a ribbon shape, a planar shape, etc. In addition, the outer periphery and the peripheral edge of the vibrating part may have any of various shapes, such as a circular shape, an elliptical shape, a polygonal shape, or a shape defined by a combination of two or more lines and curves (for example, a rectangle shape with four curved corners).

Thermoplastic Liquid Crystal Polymer

The acoustic diaphragm according to the present invention comprises the vibrating part and the edge part located at the outer periphery of the vibrating part, wherein the vibrating part comprises a thermoplastic liquid crystal polymer (TLCP) having a certain composition; and the edge part comprises a TLCP having a same composition as the TLCP of the vibrating part, so that the acoustic diaphragm has high strength and is excellent in environmental resistance characteristics such as heat resistance and cold resistance. In a preferred aspect of the present invention, the vibrating part and the edge part of the acoustic diaphragm can be united without using an preferable adhesive, so that bonded portions with such an adhesive may be omitted to preclude deterioration in the characteristics at the bonded portions due to such an adhesive.

The acoustic diaphragm according to the present invention comprises a thermoplastic liquid crystal polymer. The thermoplastic liquid crystal polymer comprises a melt-processable liquid crystalline polymer (or a polymer capable of forming an optically anisotropic melt phase). Chemical composition of the thermoplastic liquid crystal polymer is not particularly limited to a specific one as long as it is a melt-processable liquid crystalline polymer, and examples thereof may include a thermoplastic liquid crystal polyester, or a thermoplastic liquid crystal polyester amide having an amide bond introduced thereto.

The thermoplastic liquid crystal polymer may also be a polymer obtained by further introducing, to an aromatic polyester or an aromatic polyester amide, an imide bond, a carbonate bond, a carbodiimide bond, or an isocyanate-derived bond such as an isocyanurate bond.

Specific examples of the thermoplastic liquid crystal polymer used in the present invention may include known thermoplastic liquid crystal polyesters and thermoplastic liquid crystal polyester amides obtained from compounds classified as (1) to (4) as exemplified in the following, and derivatives thereof. However, it is needless to say that, in order to form a polymer capable of forming an optically anisotropic melt phase, there is a suitable range regarding the combination of various raw-material compounds.

(1) Aromatic or aliphatic diols (see Table 1 for representative examples)

TABLE 1

Chemical structural formulae of representative examples of aromatic or aliphatic diols

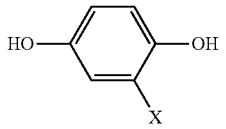

X represents a hydrogen atom or a halogen atom, or a group such as a lower alkyl (e.g., $C_{1-3}$ alkyl) or a phenyl

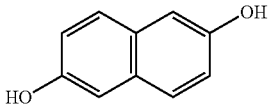

TABLE 1-continued

| Chemical structural formulae of representative examples of aromatic or aliphatic diols |
|---|
| 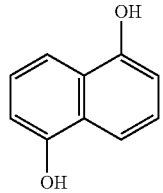 |
| 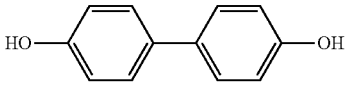 |
| 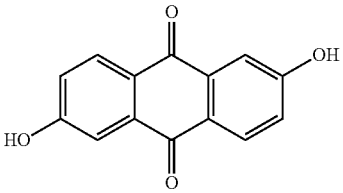 |
| 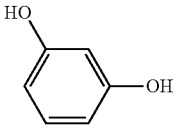 |
| 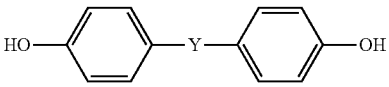 Y represents a group such as —O—, —$CH_2$—, —S—, —CO—, —$C(CH_3)_2$— , or —$SO_2$— |
| $HO(CH_2)_nOH$ n is an integer of 2 to 12 |

(2) Aromatic or aliphatic dicarboxylic acids (see Table 2 for representative examples)

TABLE 2

| Chemical structural formulae of representative examples of aromatic or aliphatic dicarboxylic acids |
|---|
| 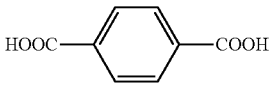 |
| 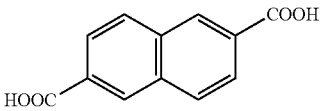 |
| 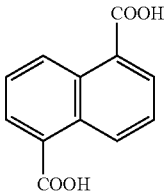 |
| 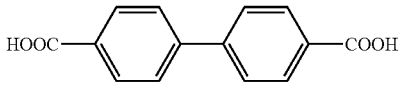 |
| 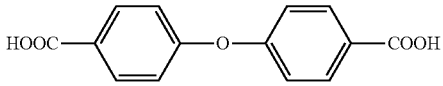 |
| 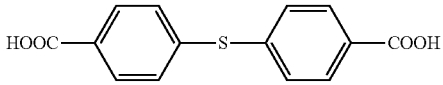 |
| 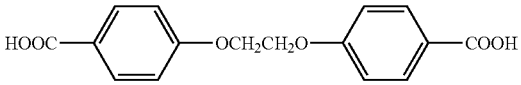 |
| 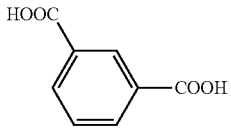 $HOOC(CH_2)_nCOOH$ n is an integer of 2 to 12 |

(3) Aromatic hydroxycarboxylic acids (see Table 3 for representative examples)

TABLE 3

| Chemical structural formulae of representative examples of aromatic hydroxycarboxylic acids |
|---|
| 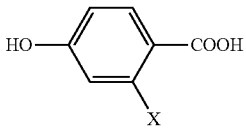 X represents a hydrogen atom or a halogen atom, or a group such as a lower alkyl (e.g., $C_{1-3}$ alkyl) or a phenyl |
| 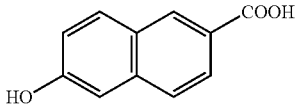 |
| 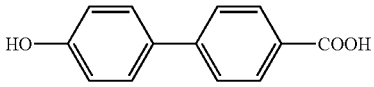 |

TABLE 3-continued

| Chemical structural formulae of representative examples of aromatic hydroxycarboxylic acids |
|---|
| 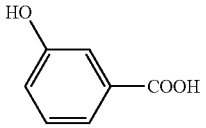 |

(4) Aromatic diamines, aromatic hydroxy amines, and aromatic aminocarboxylic acids (see Table 4 for representative examples)

TABLE 4

| Chemical structural formulae of representative examples of aromatic diamines, aromatic hydroxy amines, or aromatic aminocarboxylic acids |
|---|
| 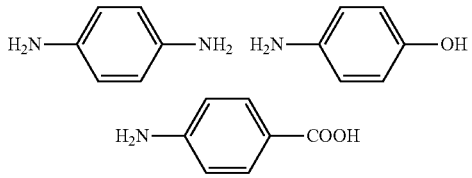 |

Representative examples of thermoplastic liquid crystal polymers obtained from these raw-material compounds may include copolymers having structural units shown in Tables 5 and 6.

TABLE 5

| Representative examples (1) of thermoplastic liquid crystal polymer | |
|---|---|
| 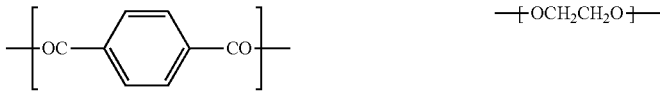 | (A) |
| 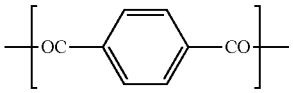 | |
| 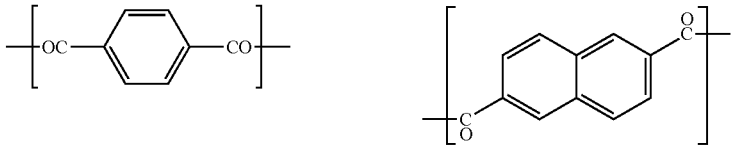 | (B) |
| 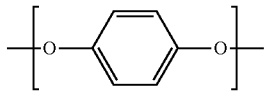 | |
| 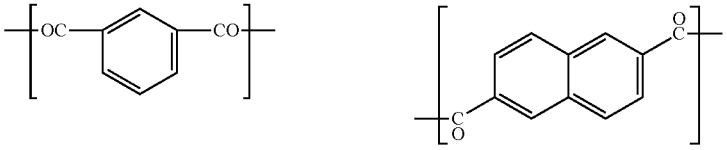 | (C) |
| 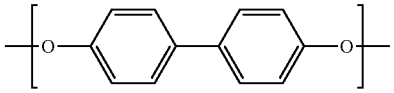 | |
| 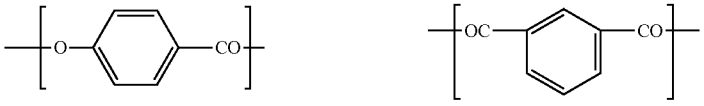 | (D) |
| 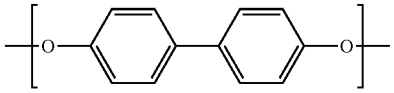 | |
| 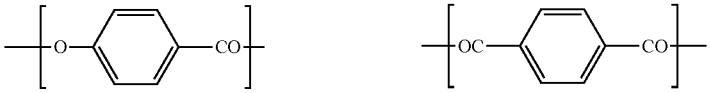 | (E) |

TABLE 5-continued
| Representative examples (1) of thermoplastic liquid crystal polymer | |
|---|---|
| 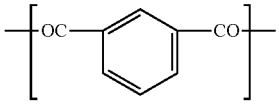 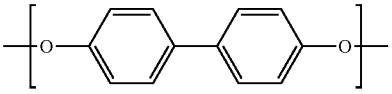 | |
| 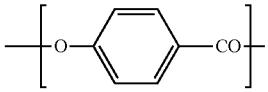 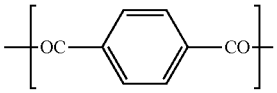 | (F) |
| 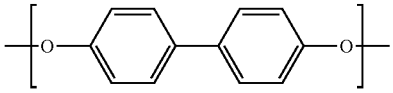 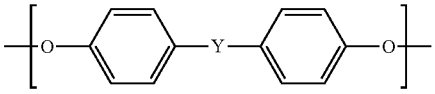 Y is a group such as —O—, —S—, or —$CH_2$— | |
| 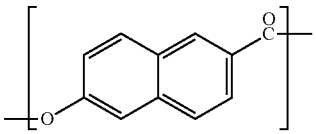 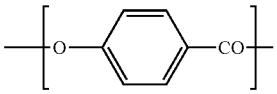 | (G) |
| 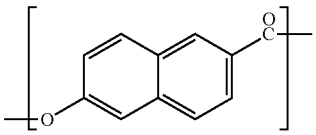 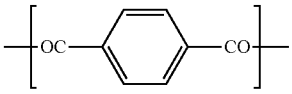 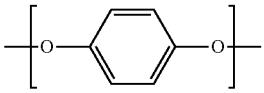 | (H) |
| 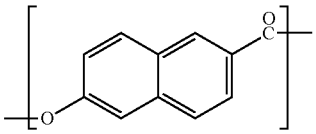 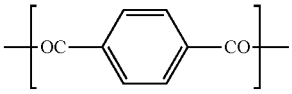 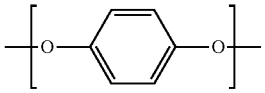 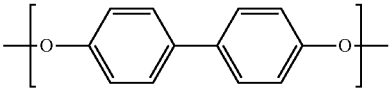 | (I) |
| 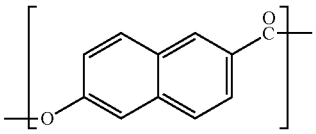 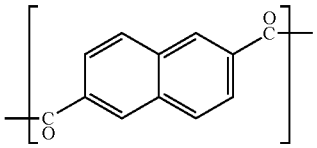 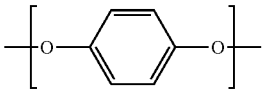 | (J) |
TABLE 6
| Representative examples (2) of thermoplastic liquid crystal polymer | |
|---|---|
| 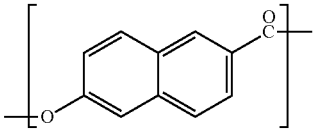 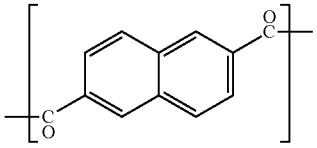 | (K) |

TABLE 6-continued
| Representative examples (2) of thermoplastic liquid crystal polymer | |
|---|---|
| 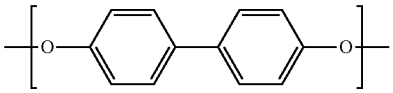 | |
| 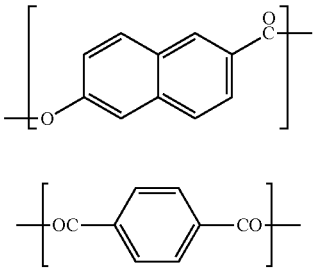  | 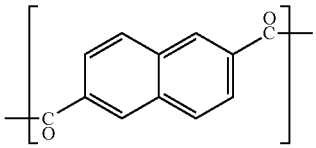 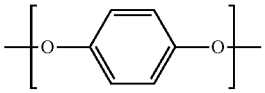 (L) |
|   | (M) |
| 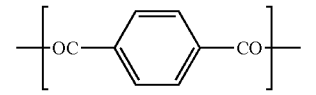 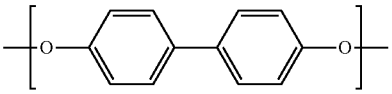 | (N) |
| 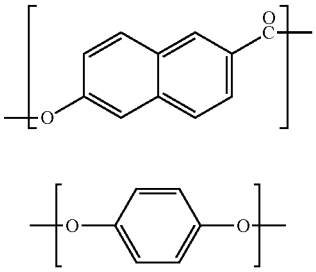  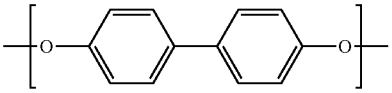 | (O) |
| 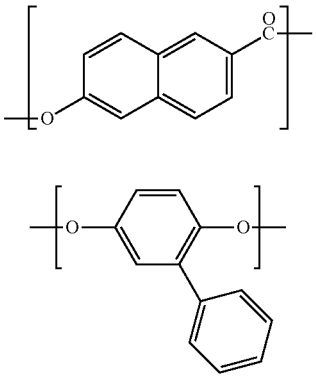  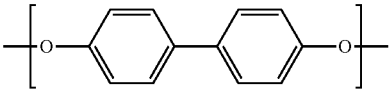 | (P) |

TABLE 6-continued

| Representative examples (2) of thermoplastic liquid crystal polymer |
|---|
| 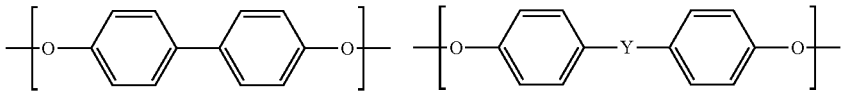 Y is a group such as —O—, —S—, or —$CH_2$— |
| 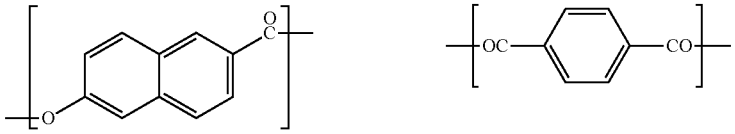 (Q) |
| 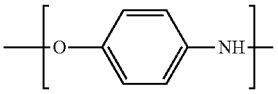 |

Of these copolymers, preferable polymers include at least p-hydroxybenzoic acid and/or 6-hydroxy-2-naphthoic acid as repeating units, and particularly preferred polymers include:

a polymer (i) having repeating units of p-hydroxybenzoic acid and 6-hydroxy-2-naphthoic acid; and a copolymer (ii) having repeating units of at least one aromatic hydroxycarboxylic acid selected from a group consisting of p-hydroxybenzoic acid and 6-hydroxy-2-naphthoic acid, at least one aromatic diol and/or aromatic hydroxy amine, and at least one aromatic dicarboxylic acid.

For example, in the case where the polymer (i) comprises a thermoplastic liquid crystal polymer having repeating units of at least p-hydroxybenzoic acid (A) and 6-hydroxy-2-naphthoic acid (B), the thermoplastic liquid crystal polymer may have a mole ratio (A)/(B) of preferably about (A)/(B)=10/90 to 90/10, more preferably about (A)/(B)–15/85 to 85/15, and further preferably about (A)/(B)–20/80 to 80/20.

Furthermore, in the case where the polymer (ii) comprises a thermoplastic liquid crystal polymer having repeating units of at least one aromatic hydroxycarboxylic acid (C) selected from a group consisting of p-hydroxybenzoic acid and 6-hydroxy-2-naphthoic acid; at least one aromatic diol (D) selected from a group consisting of 4,4'-dihydroxybiphenyl, hydroquinone, phenylhydroquinone, and 4,4'-dihydroxydiphenyl ether; and at least one aromatic dicarboxylic acid (E) selected from a group consisting of terephthalic acid, isophthalic acid, and 2,6-naphthalene dicarboxylic acid, the thermoplastic liquid crystal polymer may have a mole ratio of about aromatic hydroxycarboxylic acid (C):aromatic diol (D):aromatic dicarboxylic acid (E)=30 to 80:35 to 10:35 to 10, more preferably about (C):(D):(E)=35 to 75:32.5 to 12.5:32.5 to 12.5, and further preferably about (C):(D):(E)=40 to 70:30 to 15:30 to 15.

Furthermore, the liquid crystal polymer may have a mole ratio of a repeating structural unit derived from 6-hydroxy-2-naphthoic acid to the aromatic hydroxycarboxylic acids (C), for example, of 85 mol % or higher, preferably 90 mol % or higher, and more preferably 95 mol % or higher. The liquid crystal polymer may have a mole ratio of a repeating structural unit derived from 2,6-naphthalene dicarboxylic acid to the aromatic dicarboxylic acids (E), for example, of 85 mol % or higher, preferably 90 mol % or higher, and more preferably 95 mol % or higher.

The aromatic diol (D) may include repeating structural units (D1) and (D2) derived from two different aromatic diols each selected from a group consisting of hydroquinone, 4,4'-dihydroxybiphenyl, phenylhydroquinone, and 4,4'-dihydroxydiphenyl ether. In such a case, the two aromatic diols may have a mole ratio (D1)/(D2)=23/77 to 77/23, more preferably 25/75 to 75/25, and further preferably 30/70 to 70/30.

Furthermore, the liquid crystal polymer may have a mole ratio of a repeating structural unit derived from an aromatic diol to a repeating structural unit derived from an aromatic dicarboxylic acid of preferably (D)/(E)=95/100 to 100/95. Deviation from this range may tend to result in a low degree of polymerization and deterioration in mechanical strength.

It should be noted that, in the present invention, optical anisotropy in a molten state can be determined by, for example, placing a sample on a hot stage, heating the sample at an elevating temperature in nitrogen atmosphere, and observing light transmitted through the sample.

A preferred thermoplastic liquid crystal polymer has a melting point (hereinafter, referred to as $Tm_0$) in a range of, for example, from 200° C. to 360° C., preferably from 240° C. to 350° C., and more preferably from 260° C. to 330° C. The melting point may be determined by observing thermal behavior of a TLCP polymer sample using a differential scanning calorimeter. That is, a melting point of a TLCP sample may be determined by subjecting the sample to temperature elevation from room temperature (for example, 25° C.) at a rate of 10° C./min to completely melt the sample, then to rapid cooling to 50° C. at a rate of 10° C./min, and again to temperature elevation at a rate of 10° C./min to determine the position of an endothermic peak that occurs during the second temperature elevation as the melting point of the polymer sample.

In terms of melt processability, the thermoplastic liquid crystal polymer may have a melt viscosity of, for example, from 30 to 120 Pa-s and preferably from 50 to 100 Pa·s at a temperature of ($Tm_0$+20)° C. at a shear rate of 1000/s.

As long as the advantageous effect of the present invention is not deteriorated, to the thermoplastic liquid crystal polymer, may be added any thermoplastic polymer such as a polyethylene terephthalate, a modified polyethylene terephthalate, a polyolefin, a polycarbonate, a polyarylate, a polyamide, a polyphenylene sulfide, a polyether ether ketone, and a fluorine-containing resin; reinforcing fibers such as carbon fibers, glass fibers, aramid fibers, mica, graphite, whiskers; and/or various additives. It should be noted that the acoustic diaphragm according to the present invention may be formed from a TLCP molded product without reinforcing fibers in order to suppress decrease in internal loss.

Method of Producing Acoustic Diaphragm

A method of producing an acoustic diaphragm according to the present invention, the acoustic diaphragm comprising a vibrating part and an edge part located at an outer periphery of the vibrating part, wherein the vibrating part and the edge part are formed from a TLCP film as a base material, the method may at least comprise:

subjecting a portion of the TLCP film to heat treatment at a temperature of from (Tm−30)° C. to (Tm+30°) C, the portion being used as the edge part, or subjecting an edge part piece for a TLCP molded product to heat treatment at a temperature of from (Tm−30)° C. to (Tm+30°) C, the edge part piece being molded from the TLCP film.

Thermoplastic Liquid Crystal Polymer Film

The method of producing the acoustic diaphragm according to the present invention may comprise providing a TLCP film. The TLCP film may be obtained by, for example, extruding a melt-kneaded product of the TLCP. Any extruding method may be used, and industrially advantageous methods include well-known T-die method and inflation method. In particular, in the inflation method, stress can be applied not only in a machine direction (hereinafter, abbreviated as MD) of a TLCP film but also in a direction perpendicular thereto (hereinafter, abbreviated as TD) to draw the film uniformly in the MD and TD, so that the obtained TLCP film can have a controlled molecular orientation, etc. in the MD and TD. For this reason, in terms of uniformity in physical properties, it is preferable to use a TLCP film produced by the inflation method.

For example, in extrusion by T-die method, a TLCP film may be obtained by drawing a molten sheet body extruded from a T-die not only in an MD of the film but also in a TD simultaneously, or drawing a molten sheet body extruded from a T-die first in an MD of the film and then in TD.

In extrusion by inflation method, a TLCP film may be obtained by drawing a cylindrical sheet melt-extruded from a ring die at a predetermined drawing ratio (which corresponds to a drawing factor in an MD) and a predetermined blowing ratio (which corresponds to a drawing factor in a TD).

As for such a drawing factor in extrusion, the drawing factor (or drawing ratio) in the MD may be, for example, from about 1.0 to 10, preferably from about 1.2 to 7, and further preferably from about 1.3 to 7. The drawing factor (or blowing ratio) in the TD may be, for example, from about 1.5 to 20, preferably from about 2 to 15, and further preferably from about 2.5 to 14.

The TLCP film may have an isotropic molecular orientation in a plane direction in order to make a vibration property uniform. Specifically, the TLCP film may have a segment orientation ratio (SOR) of from 0.80 to 1.30, preferably from about 0.85 to 1.25, and more preferably from about 0.90 to 1.20. The SOR is an indicator of a molecular orientation degree of segments constituting molecules and is a value calculated in consideration of a thickness of an object. The SOR is calculated in the following manner.

First, in a well-known microwave molecular orientation measurement apparatus, a TLCP film is inserted into a microwave resonant waveguide in such a way that a film plane is perpendicular to a travel direction of microwaves to measure an electric field intensity of the microwaves transmitted through the film (i.e., microwave transmission intensity).

Then, based on the measurement, an "m" value (referred to as refractive index) is calculated by the following formula:

$$m=(Zo/\Delta z)\times[1-\nu max/\nu o].$$

In the formula, Zo denotes an apparatus constant, Δz denotes an average thickness of an object, νmax denotes a vibration frequency that gives a maximum microwave transmission intensity when the vibration frequency of the microwaves is changed, and νo denotes a vibration frequency that gives a maximum microwave transmission intensity when the average thickness is zero (that is, no object is placed).

Next, an SOR is calculated as $m_0/m_{90}$, in which $m_0$ denotes an m value when an object has a rotation angle of 0° with respect to a vibration direction of the microwaves, i.e., when a vibration direction of the microwaves coincides with a direction in which molecules of the object is best oriented and which gives a minimum microwave transmission intensity; and $m_{90}$ denotes an m value when the rotation angle is 90°.

Thermoplastic Liquid Crystal Polymer Molded Product

The method of producing the acoustic diaphragm according to the present invention may comprise molding the TLCP film to a desired shape of the acoustic diaphragm to give a TLCP molded product. It should be noted a shaped TLCP film may be referred to as a molded product or a TLCP molded product.

As methods for the molding, various thermoforming processes may be mentioned such as pressure forming process, vacuum forming process, and press forming process. For example, by the pressure forming process or vacuum forming process, a TLCP film may be molded to a desired shape for an acoustic diaphragm by using a mold. The pressure forming process may include making a film soften and then applying pressure to the film by air pressure or the like to force the film into a mold for molding. The vacuum forming process may include making a film soften and then making a vacuum in a gap between a mold and the film so as to force the film into the mold for molding. The press forming process may include placing a film between a pair of upper and lower molds, heating the film between the molds to make it soften, and molding the film.

The molding process may be carried out at a heating temperature of from (Tm−120)° C. to (Tm+10°) C, in which Tm denotes a melting point of the TLCP film. The molding process may be preferably carried out at a heating temperature of from (Tm−110)° C. to (Tm+10°) C, and more preferably from (Tm−100)° C. to (Tm+10°) C. It should be noted that the melting point (Tm) of the TLCP film is determined using a differential scanning calorimeter and indicates the position of an endothermic peak that occurs while a sample of the TLCP molded product with a predetermined size is heated in a sample container from the room temperature to 400° C. at a rate of 10° C./min.

For example, in the pressure forming process, the pressure applied to the TLCP film can be adjusted in accordance with the thickness of the TLCP film, the heating temperature, and the like and may be, for example, from 1 MPa to 10 MPa, preferably from 1 MPa to 8 MPa, and more preferably from 1 MPa to 4 MPa.

For example, in the vacuum forming process, the degree of vacuum can be adjusted in accordance with the thickness of the TLCP film, the heating temperature, and the like and may be, for example, from 200 to 700 mmHg, preferably from 250 to 600 mmHg, and more preferably from 300 to 500 mmHg.

As one aspect, the method of producing the acoustic diaphragm according to the present invention, the acoustic diaphragm comprising a vibrating part and an edge part, wherein the vibrating part and the edge part are formed from a TLCP film as a base material, the method may comprise:

subjecting a portion of the TLCP film to heat treatment, the portion being used as the edge part, or subjecting an edge part piece for a TLCP molded product to heat treatment, the edge part piece being molded from the TLCP film.

It should be noted that the expressions such as "a portion of the TLCP film, the portion being used as the edge part, a portion of the TLCP film corresponding to an edge part," or the like herein refer to a portion of the TLCP film to be molded as an edge part both before and during molding.

For example, in the method of producing the acoustic diaphragm according to the present invention, the TLCP film may be molded as a single piece to form the vibrating part and the edge part, or a piece of a TLCP film or a molded product corresponding to the vibrating part and a piece of a TLCP film or a molded product corresponding to the edge part may be separately produced and be bonded together by thermocompression bonding. Where separate pieces are produced for the vibrating part and the edge part, these pieces of the TLCP films or molded products after the later-described heat treatment may be bonded together by thermocompression bonding, or the pieces of the TLCP films or molded products may be bonded together by thermocompression bonding before they are subjected to the heat treatment.

The thermocompression bonding may be applied to bond the vibrating part piece and the edge part piece for practical applications. For example, the thermocompression bonding may be carried out at a temperature of from about (Tm−30)° C. to (Tm+40°) C, and preferably from about (Tm−20)° C. to (Tm+30°) C, in which Tm denotes a melting point of the TLCP film. The thermocompression bonding may be carried out at a pressure of, for example, from 0.5 to 10 MPa, and preferably from 1 to 5 MPa.

Heat Treatment

The heat treatment may be carried out to a portion of the TLCP film corresponding to the edge part or may be carried out to an edge part piece for the TLCP molded product so as to decrease an elastic modulus of the edge part. The heat treatment may be carried out to the TLCP film before molding, or to the TLCP film during molding, or to the TLCP molded product after molding. The present inventors have surprisingly found that TLCP films have a completely different property from conventional polymer materials in that the heated TLCP films can have a reduced elastic modulus while maintaining high internal loss presumably because of relaxation of molecular orientation of the thermoplastic liquid crystal polymer through the heat treatment. Further, the inventers have found that, thanks to this nature, the heat treatment to a portion of the TLCP film or the TLCP molded product corresponding to the edge part makes it possible to simultaneously achieve the required properties, i.e., to impart high elastic modulus to the vibrating part and low elastic modulus to the edge part, in spite of the fact that the vibrating part and the edge part of the acoustic diaphragm are made of a same compositional material.

The heat treatment can be carried out by a well-known method. In particular, there may be mentioned as preferred methods which enable local heating, and examples of such methods may include: temperature-controlling heat treatment using hot air, steam, thermo-heater, etc.; and thermal energy-controlling heat treatment using laser, electron beam, ultrasonic heater, etc. For example, preferable heat treatment may include heat treatment using thermo-heater, laser, and/or ultrasonic heater from the viewpoint of locally controlled heat treatment.

Heat treatment using thermo-heater is preferable because temperature control can be easily performed, and various thermo-heaters can be used depending on the shape of the acoustic diaphragm. For example, in a case of a round acoustic diaphragm, a ring-shaped thermo-heater may be used.

Heat treatment using ultrasonic heater as well as laser is also preferable because they not only enable heating and cooling each in a short period of time but also enable heating at only a subjected portion.

Where temperature control is performed, the heat treatment temperature can be suitably adjusted depending on a desired elastic modulus and may be, for example, from (Tm−30)° C. to (Tm+30°) C, preferably from (Tm−25)° C. to (Tm+20°) C, and more preferably from (Tm−20)° C. to (Tm+10°) C.

The heat treatment time can also be suitably adjusted depending on the heat treatment temperature. In terms of adjusting only the elastic modulus of the edge part without changing the elastic modulus of other portion than the heated portion, the heat treatment time may be from 30 seconds to 30 minutes, preferably from 2 minutes to 25 minutes, and more preferably from 5 minutes to 20 minutes.

The heat treatment may be carried out on a portion of the TLCP film or of the TLCP molded product corresponding to the vibrating part. In such a case, a portion corresponding to the edge part may be subjected to heat treatment at a higher temperature than that for a portion corresponding to the vibrating part. For example, the portion corresponding to the edge part may be subjected to heat treatment at a higher temperature than that for the portion corresponding to the vibrating part with a temperature difference of 5° C. or greater, preferably 8° C. or greater, and more preferably 10° C. or greater.

Figure 4:
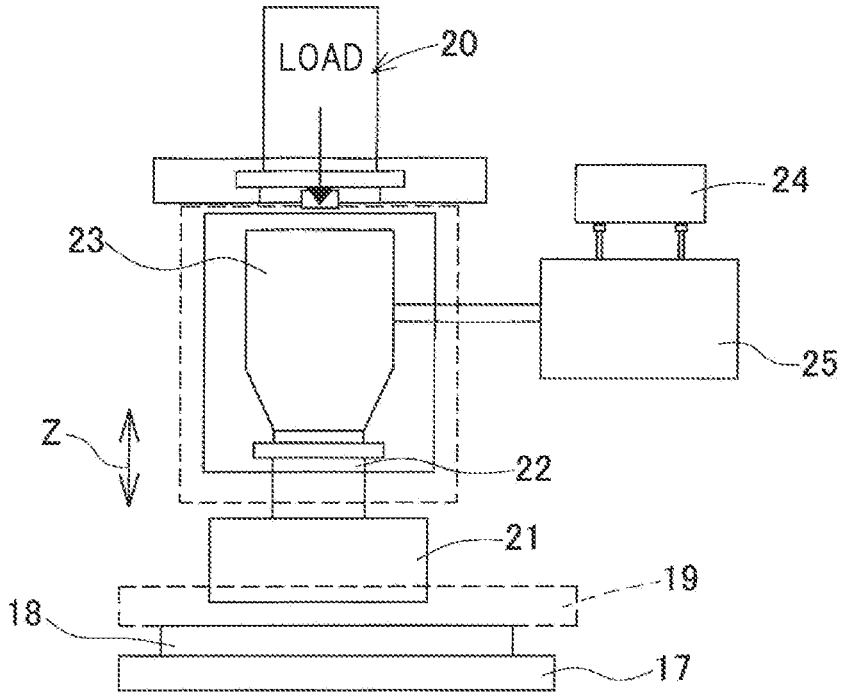
FIG. 4 schematically shows an ultrasonic heater for carrying out ultrasonic heat treatment to the acoustic diaphragm.

The heat treatment may be carried out during the molding process or during the bonding process between the vibrating part piece and the edge part piece. For example, heat treatment for controlling the elastic modulus of the edge part may be carried out at the same time as heating for the molding or bonding. In such a case, the portion corresponding to the edge part may be subjected to heat treatment at a higher temperature than that for the portion corresponding to the vibrating part with the above temperature difference.

Where the thermal energy-controlling heat treatment is carried out, for example, in the case of ultrasonic heat treatment, as shown in FIG. 4, a TLCP film or TLCP molded product 19 is placed on an anvil 18 supported by a base 17, and an ultrasonic heater applies ultrasonic vibration from a tip end of a horn 21 thereof to a portion of the TLCP film or TLCP molded product corresponding to the edge part, while a load is applied thereto using a pressurizing device 20. The ultrasonic heater of this embodiment applies, from the tip end of the horn 21, vibration in a vertical direction Z to the target portion corresponding to the edge part, the vertical direction being perpendicular to the target portion. The horn 21 is connected to an ultrasonic vibrator 23 through a corn 22. The ultrasonic vibrator 23 controls the ultrasonic vibration using an ultrasonic oscillator 25 connected to a power source 24.

Figure 5:
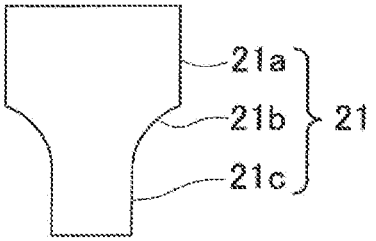
FIG. 5 partially shows the shape of a tip end of a horn of the ultrasonic heater.
Figure 6:
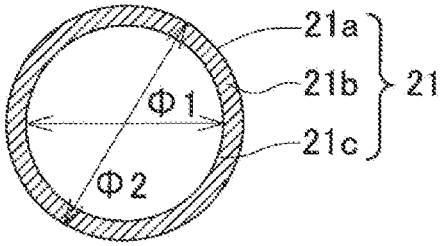
FIG. 6 is a bottom view of the horn.

As shown in FIG. 5 and FIG. 6, the horn 21 is provided with a large-diameter cylindrical part 21*a* on a connected side, a truncated cone part 21*b*, and a mall-diameter cylindrical part 21*c*. The truncated cone part has a reducing diameter toward a lower portion thereof from a connecting edge of the large-diameter cylindrical part 21*a*. The small-diameter cylindrical part 21*c* extends downward from a connecting edge of the truncated cone part 21*b*. The small-diameter cylindrical part 21*c* has a smaller diameter than the diameter of the large-diameter cylindrical part 21*a*. These large-diameter cylindrical part 21*a*, the truncated cone part 21*b*, and the small-diameter cylindrical part 21*c* are coaxially arranged and are formed in a single piece. Vibration is applied from a tip end of the small-diameter cylindrical part 21*c* to the portion corresponding to the edge part.

In the thermal energy-controlling heat treatment, the treatment condition(s) may be suitably set depending on a medium to which thermal energy is applied for adjustment of the elastic modulus of the edge part. For example, as a treatment condition in the ultrasonic heat treatment, the oscillation frequency may be, for example, from 10 to 150 kHz, and preferably from 28 to 120 kHz, so that a target object can start melting earlier. The oscillation amplitude may be, for example, from 1 to 100 μm, and preferably from 5 to 20 μm.

The oscillation retention time while the horn is kept in contact in the ultrasonic heat treatment may be suitably set depending on the frequency and/or peak power and may be, for example, from 0.05 to 5 seconds, and preferably from 0.1 to 1.0 second. The pressure at which the horn is pressed may be suitably set depending on the thickness of the edge part and the like and may be, for example, from 0.05 to 1.0 MPa, and preferably from 0.08 to 0.8 MPa. The output may be suitably set depending on the size of the edge part and may be, for example, from 100 to 1000 W, and preferably from 180 to 800 W. Following the oscillation retention time of the horn, there may be preferably a predetermined cooling time for allowing to cool the edge part, and the cooling time may be, for example, 0.1 second or longer. An upper limit for the cooling time may be suitably set within a range in which the edge part can be cooled, and may be, for example, 10 seconds or shorter, preferably 5 seconds or shorter, more preferably 1 second or shorter, and particularly preferably 0.5 seconds or shorter.

Coating treatment may be performed to the thus-obtained TLCP film or TLCP molded product to form a coating layer as needed, as long as the thickness of the film or molded product can be adjusted to be small. The coating treatment is not limited to a specific one as long as the film or molded product can be adjusted to a desired thickness, and the coating treatment may be performed to the molded product by applying (painting), spraying, vapor deposition, or the like. The coating treatment may be performed to at least one surface of the molded product. Further, the coating treatment may be performed to the surface(s) of the vibrating part and/or the edge part.

A material constituting the coating layer may preferably contain a metal material, such as aluminum, titanium, beryllium, magnesium, titanium boride, duralumin, etc. The coating treatment may be carried out with a metal material by applying or spraying a metal powder and a binder or by vapor deposition.

The coating layer may have a thickness of, for example, from about 0.5 to 10 μm, preferably from about 1 to 5 μm, more preferably from about 1 to 3 μm.

Acoustic Diaphragm

An acoustic diaphragm according to the present invention comprises a vibrating part and an edge part located at an outer periphery of the vibrating part, wherein the vibrating part comprises a TLCP having a certain composition; the edge part comprises a TLCP having a same composition as the TLCP of the vibrating part; and the vibrating part and the edge part have elastic moduli $E_d$ and $E_e$ measured by nanoindentation technique, respectively, which satisfy the following formula: $E_d > E_e$.

In the acoustic diaphragm according to the present invention, each of the vibrating part and the edge part of is made of a thermoplastic liquid crystal polymer having a same composition. The vibrating part and the edge part may be formed in a single piece from a single TLCP film, or separate pieces of TLCP films or molded products may be prepared as a portion corresponding to the vibrating part and a portion corresponding to the edge part, and be subsequently bonded together by thermocompression bonding. In order to suppress variation in thickness as well as to facilitate production thereof, the acoustic diaphragm may be preferably constructed such that the vibrating part and the edge part located at the outer periphery of the vibrating part are formed as a single piece made of a thermoplastic liquid crystal polymer.

The term "same composition" only requires that TLCPs have substantially same copolymerization compositions, and they may have different molecular weights or crystal structures. For instance, where the respective pieces are prepared from a same TLCP film, these pieces have a substantially same copolymerization composition. Where the respective parts are formed as a single piece, they have a same composition. The term "copolymerization composition" indicates types and a molar ratio of repeating units constituting a TLCP.

Nanoindentation technique refers to a testing method including measuring indentation loads and indentation depths upon intrusion of an indenter perpendicularly on a sample surface to obtain a relation between load and depth, and determining a contact stiffness (stiffness: S) and a contact depth ($h_c$) to calculate an elastic modulus (Young's modulus). Each elastic modulus measured by nanoindentation technique is a value calculated by the method described in Examples.

For example, in the acoustic diaphragm according to the present invention, a ratio $E_d/E_e$ of the elastic modulus $E_d$ of the vibrating part to the elastic modulus $E_e$ of the edge part measured by nanoindentation technique may fall within a range of from 1.05 to 5.0. The ratio $E_d/E_e$ may preferably fall within a range of from 1.1 to 4.0, and more preferably from 1.2 to 3.0.

In the acoustic diaphragm according to the present invention, in order to suppress divided vibration and to expand a reproduction frequency band, the elastic modulus $E_d$ of the vibrating part measured by the nanoindentation technique may be from 6.0 to 15.0 GPa, preferably from 6.5 to 14.0 GPa, and more preferably from 7.0 to 13.0 GPa.

In the acoustic diaphragm according to the present invention, in order to maintain the shape of the vibrating part and to avoid interference with vibration, the elastic modulus $E_e$ of the edge part measured by the nanoindentation technique may be, for example, from 4.5 to 12.0 GPa, preferably from 5.0 to 12.0 GPa, more preferably from 5.5 to 11.0 GPa, and further preferably from 6.0 to 10.0 GPa.

The acoustic diaphragm according to the present invention may simultaneously have different properties required for the vibrating part and the edge part, namely, high elastic modulus in the vibrating part and low elastic modulus in the edge part. High elastic modulus in the vibrating part makes it possible to, for example, suppress divided vibration and expand the reproduction frequency band. Low elastic modulus in the edge part makes it possible to support and retain the outer periphery of the vibrating part at an appropriate position and allow the edge part to follow a movement of the vibrating part without disturbing the movement.

In the acoustic diaphragm according to the present invention, in order to suppress a resonant peak in divided vibration and to uniformize frequency characteristics, each of the vibrating part and the edge part may have an internal loss tan δ of from 0.03 to 0.08, preferably from 0.04 to 0.08, and more preferably from 0.05 to 0.08. The internal loss can be measured by dynamic mechanical analysis (DMA) and is a value calculated by the method described in Examples.

For example, in the acoustic diaphragm according to the present invention, a ratio $\tan \delta_d/\tan \delta_e$ of the internal loss $\tan \delta_d$ of the vibrating part to the internal loss $\tan \delta_e$ of the edge part may be from 0.8 to 1.2, and preferably from 0.9 to 1.1.

In the acoustic diaphragm according to the present invention, the edge part may have a smaller thickness than that of the vibrating part in order to reduce the rigidity of the edge part. For example, the acoustic diaphragm may have different thicknesses between the vibrating part and the edge part with a difference in thickness of 10 μm or smaller, preferably 5 μm or smaller, and more preferably 3 μm. In a case where the edge part includes a groove, the groove part is not considered in determining the difference in thickness.

As shown in FIG. 3, the thickness t1 of the vibrating part 11 of the acoustic diaphragm 10 may be suitably set in accordance with the acoustic device in which the acoustic diaphragm 10 is installed. The thickness may be, for example, selected from about 5 to 200 μm, may be preferably from about 10 to 180 μm, and more preferably from about 15 to 150 μm. In general, a larger acoustic diaphragm 10 tends to require a thicker film, and a smaller acoustic diaphragm 10 tends to require a thinner film. For example, the thickness t1 of the vibrating part 11 of the acoustic diaphragm 10 may be preferably from 15 to 25 pnm in a case of, e.g., an earphone in which the acoustic diaphragm has a diameter of from 5 mm to 15 mm. The thickness t1 of the vibrating part 11 of the acoustic diaphragm 10 may be preferably from 25 to 50 μm in a case of, e.g., a headphone in which the acoustic diaphragm has a diameter of from 15 mm to 40 mm. The thickness t1 of the vibrating part 11 of the acoustic diaphragm 10 may be preferably from 75 to 150 μm in a case of, e.g., a vehicle loudspeaker in which the acoustic diaphragm has a diameter of about 100 mm.

The thickness t2 of the edge part 12 of the acoustic diaphragm 10 may be suitably set depending on the acoustic device in which the acoustic diaphragm 10 is installed and may be, for example, from about 3 to 200 μm, preferably from about 5 to 170 μm, and more preferably from about 10 to 150 μm.

Although the acoustic diaphragm according to the present invention is made of a TLCP, the TLCP film and TLCP molded product advantageously have a small change in properties such as elastic modulus and internal loss, even at a temperature higher than the glass transition temperature until the temperature rises close to the melting point. For example, acoustic diaphragms used for vehicle audios, smartphones, or the like may be exposed to high temperature environments at temperatures of 150° C. or higher. The acoustic diaphragm according to the present invention does not exhibit a large change in elastic modulus and internal loss under such a high temperature condition, so that this acoustic diaphragm can be used for applications for which heat resistance is required.

Acoustic Device

The acoustic device is not limited to a specific one as long as the device comprises an acoustic diaphragm according to the present invention. Examples of such a device may include: a device which is brought into direct contact with the ear(s) of a user who receives sound from the acoustic device (such as headphones, earphones); a device which is brought close to the ear of a user who receives sound from the acoustic device (such as mobile phones, smartphones); and a device which is placed away from a user who receives sound from the acoustic device over a certain space (such as loudspeakers, audios, radios, televisions, personal computers, vehicle audios). For example, the acoustic diaphragm according to the present invention is excellent in environmental resistance characteristics such as heat resistance, so that the acoustic diaphragm may be used in a vehicle audio, a personal computer, etc. The acoustic device according to the present invention may be a full-range loudspeaker.

Further, since the vibrating part and the edge part of the acoustic diaphragm according to the present invention are made of a same material, the acoustic diaphragm may be used in a microspeaker that is required to be compact and thin. The acoustic device according to the present invention may be an electronic device equipped with such a microspeaker (for example, a portable acoustic device such as a headphone, an earphone, and a portable loudspeaker; a portable electronic device such as a mobile phone and a smartphone; or an electronic device such as a laptop computer).

EXAMPLES

Hereinafter, the present invention will be specifically described with reference to Examples which are not to be construed as limiting the scope of the present invention. In the Examples and Comparative Examples below, various physical properties were determined in the following manners.

Melting Point

A melting point Tm of a TLCP film used in each Example was determined using a differential scanning calorimeter (manufactured by Shimadzu Corporation). A sample of the TLCP film with a predetermined size was placed in a sample container. The film was subjected to temperature elevation from room temperature to 400° C. at a rate of 10° C./min to determine the position of an endothermic peak as the melting point of the film.

Thickness

In accordance with JIS K 7130, Method A, a thickness of each film was measured by mechanical scanning using a micrometer (MDC-MX, manufactured by Mitutoyo Cooperation).

Elastic Modulus

As for each of a vibrating part and an edge part of an acoustic diaphragm obtained in each Example, an elastic modulus was determined by nanoindentation technique in the following manner using a scanning probe microscope "E-sweep" manufactured by SII NanoTechnology Inc., and a nanoindenter "TriboScope" manufactured by Hysitron Inc., with a regular triangular pyramid (Berkovich type) indenter (142.3°) manufactured by Hysitron Inc., as a diamond indenter. In each measurement, the indenter tip was pushed into a sample for 3 seconds (loading) and was pulled out therefrom for 3 seconds (unloading) with a set load of 300 μN and an indentation depth of approximately 200 nm in an environment at a temperature of 23° C. and a humidity of 43% to create a load-displacement curve including a load region, a hold region, and an unload region. A stiffness S (contact stiffness) was calculated from a slope of the unload portion in the curve, and a contact depth ($h_c$) was calculated by the following formula:

$$h_e = h_t - \varepsilon(P/S).$$

In the formula, $h_t$ denotes a measured indention depth (nm), ε denotes a constant relating to the shape of the indenter (0.75 for a Berkovich indenter), and P denotes a maximum load (μN).

A projected contact area A of an indent at the contact depth was calculated from the contact depth $h_c$ by the following formula:

$$A = 24.56 h_c^2.$$

An elastic modulus $E_s$ was calculated from a composite elastic modulus $E_r$ by the following formula.

$$E_r = \left[\frac{(1-\upsilon_s^2)}{E_s} + \frac{(1-\upsilon_i^2)}{E_i}\right]^{-1} = \frac{\sqrt{\pi}}{2} \cdot \frac{S}{\beta\sqrt{A}} \quad \text{Math 1}$$

In the formula, E; denotes a Young's modulus of the indenter, $\nu_i$ denotes a Poisson's ratio of the indenter, $\nu_s$ denotes a Poisson's ratio of a sample, and β denotes a constant determined in accordance with the shape of the indenter.

As for each of the vibrating part and the edge part, 10 indents were formed in an area of 10 μm×10 μm, and the same measurement was repeated three times at different sites (n=3). An average of the measurements was calculated as an elastic modulus of each part.

Internal Loss

A rectangular specimen (4 mm×10 mm) was measured using a dynamic viscoelasticity analyzer (FT-Rheospectra DVE-V4, manufactured by Rheology Co. Ltd.) at a frequency of 10 Hz, a temperature elevating rate of 3° C./min (from −100° C. to +300° C.), and a strain of 0.025% to give a complex clastic modulus at 20° C. A ratio of an imaginary part (E": loss elastic modulus) to a real part (E': storage elastic modulus) of the complex elastic modulus was calculated. Then, an internal loss (tan δ) was calculated from the ratio (E"/E').

Example 1

A TLCP film ("Vecstar" (trademark) available from KURARAY CO., LTD.; melting point 280° C., thickness 25 μm, and SOR 1.10) was molded by pressure forming at a temperature of 220° C. under a pressure of 2 MPa to obtain a TLCP molded product having a shape as shown in FIG. 2 and FIG. 3. The TLCP molded product had a diameter of 40 mm as a whole, in which the vibrating part had a diameter of 20 mm.

Heat treatment was carried out to a portion of the TLCP molded product corresponding to an edge part at 275° C. for 1 minute using a thermo-heater to produce an acoustic diaphragm. Table 7 shows the measurement results of the physical properties.

Example 2

An acoustic diaphragm was produced in the same manner as Example 1 except that the heat treatment was carried out at 280° C. Table 7 shows the measurement results of the physical properties.

Example 3

A TLCP film ("Vecstar" (trademark) available from KURARAY CO., LTD.; melting point 305° C., thickness 25 μm, SOR 1.10) was molded by pressure forming at a temperature of 220° C. under a pressure of 2 MPa to obtain a TLCP molded product having a shape as that of Example 1.

Heat treatment was carried out to a portion of the TLCP molded product corresponding to an edge part at 300° C. for 1 minute using a heater to produce an acoustic diaphragm. Table 7 shows the measurement results of the physical properties.

Example 4

An acoustic diaphragm was produced in the same manner as Example 1 except that the heat treatment to the edge part was carried out using an ultrasonic heater ("HW-D250S-28" manufactured by Nippon Avionics Co., Ltd.; oscillation frequency: 28 kHz, oscillation amplitude: 10 μm, output: 180 W, pressure: 0.1 MPa, retention time: 1.0 second, cooling time: 0.1 seconds). Table 7 shows the measurement results of the physical properties. It should be noted that the horn in this example had a shape as shown in FIG. 6, in which the small-diameter cylindrical part 21*c* had a diameter dimension ϕ1 of 12 mm, and the large-diameter cylindrical part 21*a* had a diameter dimension ϕ2 of 14 mm.

Comparative Example 1

A PET film (25 μm thick) was molded by pressure forming at a temperature of 120° C. under a pressure of 2 MPa to obtain a TCP molded product having a same shape as that of Example 1. Then, an aluminum plate having a diameter of 20 mm (25 μm thick) was bonded to the vibrating part of the shaped molded product with an epoxy adhesive with a thickness of 13 μm to obtain an acoustic diaphragm. The bonded portions (vibrating part) had a thickness of 50 μm+12.5 μm, i.e., 62.5 μm in total, and the acoustic diaphragm as a whole weighed approximately 0.16 mg. Table 7 shows the measurement results of the physical properties.

Comparative Example 2

An acoustic diaphragm was produced by bonding an aluminum plate to the vibrating part with an epoxy adhesive in the same manner as Comparative Example 1, except that a PEEK film (25 μm thick) was used instead of a PET film, and that the film was molded to have a diameter of 40 mm by pressure forming at a temperature of 150° C. under a pressure of 2 MPa. Table 7 shows the measurement results of the physical properties.

TABLE 7

| | Production condition | | | | | | | | Acoustic diaphragm | | | | | | | |
|---|---|---|---|---|---|---|---|---|---|---|---|---|---|---|---|---|
| | | | | Heat treatment | | | | | | | | | | Thickness | | |
| | | Molding process | | | Thermo-heater | Ultrasonic heat treatment | | | Elastic modulus | | | Internal loss | | | Difference in thickness | |
| | Material type | Temp. (° C.) | Pressure (MPa) | Part | Temp. (° C.) | Frequency (kHz) | Amplitude (μm) | Pressure (MPa) | Vibrating part $E_d$ (GPa) | Edge part $E_e$ (GPa) | $E_d/E_e$ | Vibrating part | Edge part | Edge part (μm) | (μm) | Weight (mg) |
| Ex. 1 | LCP | 220 | 2 | Edge part | 275 | — | — | — | 10.3 | 7.3 | 1.4 | 0.060 | 0.060 | 25.0 | 0.0 | 0.09 |
| Ex. 2 | LCP | 220 | 2 | Edge part | 280 | — | — | — | 10.3 | 6.4 | 1.6 | 0.060 | 0.060 | 25.0 | 0.0 | 0.09 |
| Ex. 3 | LCP | 220 | 2 | Edge part | 300 | — | — | — | 10.0 | 6.0 | 1.7 | 0.060 | 0.060 | 25.0 | 0.0 | 0.09 |
| Ex. 4 | LCP | 220 | 2 | Edge part | — | 28 | 10 | 0.1 | 10.3 | 5.0 | 2.1 | 0.060 | 0.060 | 25.0 | 0.0 | 0.09 |
| Com. Ex. 1 | PET Al plate | 120 | 2 | — | — | — | — | — | 60.0 | 5.8 | 10.3 | 0.002 | 0.019 | 25.0 | 37.5 | 0.16 |
| Com. Ex. 2 | PEEK Al plate | 150 | 2 | — | — | — | — | — | 60.0 | 5.6 | 10.7 | 0.002 | 0.030 | 25.0 | 37.5 | 0.16 |

As shown in Table 7, the acoustic diaphragm of each of Examples 1 to 4 produced from a TLCP molded product can concurrently comprise a vibrating part having high elastic modulus and an edge part having low elastic modulus without any bonded portions. In addition, in spite of the fact that the edge part has a reduced elastic modulus, each acoustic diaphragm maintains internal loss, and both the vibrating part and the edge part have high internal loss. Further, since the vibrating part and the edge part are formed as a single piece, the vibrating part and the edge part do not have a difference in thickness. Thus, each acoustic diaphragm as a whole can achieve a reduced weight.

On the other hand, each of Comparative Examples 1 and 2, containing different materials bonded together to adjust the elastic moduli of the vibrating part and the edge part, has an enhanced thickness at the vibrating part as well as an increased weight due to the presence of the aluminum plate and the adhesive layer, resulting in insufficient acoustic characteristics such as a reduced propagation speed ($(E/\rho)^{1/2}$).

INDUSTRIAL APPLICABILITY

The acoustic diaphragm according to the present invention is usefully applicable as a member for various acoustic devices.

Although the present invention has been described in terms of the preferred Examples thereof with reference to the drawings, those skilled in the art would readily arrive at various changes and modifications in view of the present specification without departing from the scope of the invention. Accordingly, such changes and modifications are included within the scope of the present invention defined by the appended claims.

REFERENCE NUMERALS

10 . . . acoustic diaphragm
11 . . . vibrating part
12 . . . edge part
13 . . . pole piece
14 . . . voice coil
15 . . . magnetic body
16 . . . groove
17 . . . base
18 . . . anvil
19 . . . TLCP film or TLCP molded product
20 . . . pressurizing device
21 . . . horn
21*a* . . . large-diameter cylindrical part
21*b* . . . truncated cone part
21*c* . . . small-diameter cylindrical part
22 . . . corn
23 . . . ultrasonic vibrator
24 . . . power source
25 . . . ultrasonic oscillator
F . . . surface of the acoustic diaphragm facing the ear
R . . . surface of the acoustic diaphragm facing opposite to the ear

What is claimed is:

1. An acoustic diaphragm comprising a vibrating part and an edge part located at an outer periphery of the vibrating part, wherein the vibrating part comprises a thermoplastic liquid crystal polymer capable of forming an optically anisotropic melt phase;

the edge part comprises a thermoplastic liquid crystal polymer having a same composition as the thermoplastic liquid crystal polymer of the vibrating part; and the vibrating part and the edge part have elastic moduli $E_d$ and $E_e$ measured by nanoindentation technique, respectively, which satisfy the following formula:

$$E_d > E_e.$$

2. An acoustic diaphragm comprising a vibrating part and an edge part located at an outer periphery of the vibrating part, wherein the vibrating part comprises a thermoplastic liquid crystal polymer having a certain composition;

the edge part comprises a thermoplastic liquid crystal polymer having a same composition as the thermoplastic liquid crystal polymer of the vibrating part; and the vibrating part and the edge part have elastic moduli $E_d$ and $E_e$ measured by nanoindentation technique, respectively, which satisfy the following formula:

$$E_d > E_e,$$

wherein a ratio $E_d/E_e$ of the elastic modulus $E_d$ of the vibrating part to the elastic modulus $E_e$ of the edge part is from 1.05 to 5.0.

3. The acoustic diaphragm according to claim 1, wherein the elastic modulus $E_d$ of the vibrating part is from 6.0 to 15.0 GPa.

4. The acoustic diaphragm according to claim 1, wherein the elastic modulus $E_e$ of the edge part is from 4.5 to 12.0 GPa.

5. The acoustic diaphragm according to claim 1, wherein each of the vibrating part and the edge part has an internal loss tan δ of from 0.03 to 0.08.

6. The acoustic diaphragm according to claim 1, wherein the acoustic diaphragm has different thicknesses between the vibrating part and the edge part with a difference in thickness being 10 μm or smaller.

7. A method for producing the acoustic diaphragm according to claim 1, wherein the vibrating part and the edge part are formed from a thermoplastic liquid crystal polymer film as a base material, the method comprising:

subjecting a portion of the thermoplastic liquid crystal polymer film to heat treatment, the portion being used as the edge part, or subjecting an edge part piece for a thermoplastic liquid crystal polymer molded product to heat treatment, the edge part piece being molded from the thermoplastic liquid crystal polymer film.

8. The method according to claim 7, wherein the heat treatment is carried out at a temperature of from (Tm−30)° C. to (Tm+30)° C. wherein Tm denotes a melting point of the thermoplastic liquid crystal polymer film.

9. The method according to claim 7, wherein the heat treatment is carried out using ultrasonic treatment.

10. The method according to claim 7, wherein the thermoplastic liquid crystal polymer film before the heat treatment has a segment orientation ratio (SOR) of from 0.80 to 1.30.

11. An acoustic device comprising the acoustic diaphragm of claim 1.

12. The acoustic device according to claim 11, wherein the acoustic device is a loudspeaker, a headphone, or an earphone.

* * * * *